US010018024B2

(12) United States Patent
Greci

(10) Patent No.: US 10,018,024 B2
(45) Date of Patent: Jul. 10, 2018

(54) STEAM OPERATED INJECTION AND PRODUCTION DEVICE

(71) Applicant: Halliburton Energy Services, Inc., Houston, TX (US)

(72) Inventor: Stephen Michael Greci, Little Elm, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/541,060

(22) PCT Filed: Mar. 4, 2015

(86) PCT No.: PCT/US2015/018772
§ 371 (c)(1),
(2) Date: Jun. 30, 2017

(87) PCT Pub. No.: WO2016/140664
PCT Pub. Date: Sep. 9, 2016

(65) Prior Publication Data
US 2018/0003019 A1 Jan. 4, 2018

(51) Int. Cl.
*E21B 43/24* (2006.01)
*E21B 21/08* (2006.01)
(Continued)

(52) U.S. Cl.
CPC ..... *E21B 43/2406* (2013.01); *E21B 21/08* (2013.01); *E21B 34/101* (2013.01);
(Continued)

(58) Field of Classification Search
CPC ..... E21B 43/24; E21B 43/2406; E21B 21/08; E21B 34/101; E21B 43/122; E21B 43/241; E21B 43/305
See application file for complete search history.

(56) References Cited

U.S. PATENT DOCUMENTS 7,866,400 B2 1/2011 Steele et al.
8,096,362 B2 * 1/2012 Steele ..... E21B 34/06 166/319
(Continued)

FOREIGN PATENT DOCUMENTS

WO 2013/034185 A1 3/2013
WO 2015/023294 A1 2/2015

OTHER PUBLICATIONS

International Search Report and Written Opinion issued in related PCT Application No. PCT/US2015/018772 dated Oct. 29, 2015, 14 pages.

*Primary Examiner* — Zakiya W Bates
*Assistant Examiner* — Crystal J Miller
(74) *Attorney, Agent, or Firm* — Scott Richardson; Baker Botts L.L.P.

(57) ABSTRACT

A steam operated flow control device and method is disclosed. In one mode, the flow control device enables steam to be injected into a subterranean formation region containing hydrocarbons. In another mode, the flow control device enables the hydrocarbons to be produced from the subterranean formation to the surface. The flow control device includes a piston disposed between a housing and a mandrel having aligned ports, which slides between a first position where one set of ports align with the ports in the housing and the mandrel and a second position where another set of smaller ports align with the ports in the housing and mandrel. The piston is operated by a bellows having a chamber which contains a fluid. The fluid responds to temperature and/or pressure variations.

19 Claims, 5 Drawing Sheets

(51) Int. Cl.

| | |
|---|---|
| ***E21B 43/12*** | (2006.01) |
| ***E21B 34/10*** | (2006.01) |
| *E21B 43/241* | (2006.01) |
| *E21B 43/30* | (2006.01) |

(52) U.S. Cl.
CPC ..... *E21B 43/122* (2013.01); *E21B 43/241* (2013.01); *E21B 43/305* (2013.01)

(56) References Cited

U.S. PATENT DOCUMENTS

| | | | | |
|---|---|---|---|---|
| 8,496,059 | B2 | 7/2013 | Schultz et al. | |
| 8,863,840 | B2 | 10/2014 | Schultz et al. | |
| 2010/0126720 | A1 | 5/2010 | Kaiser et al. | |
| 2011/0073295 | A1* | 3/2011 | Steele ..... | E21B 34/06 166/53 |
| 2014/0054028 | A1 | 2/2014 | Little et al. | |
| 2014/0069641 | A1 | 3/2014 | Kosik et al. | |
| 2015/0218909 | A1* | 8/2015 | Yeh ..... | E21B 43/08 166/305.1 |

* cited by examiner

STEAM OPERATED INJECTION AND PRODUCTION DEVICE

CROSS-REFERENCE TO RELATED APPLICATION

The present application is a U.S. National Stage Application of International Application No. PCT/US2015/018772 filed Mar. 4, 2015, which is incorporated herein by reference in its entirety for all purposes.

TECHNICAL FIELD

This disclosure relates generally to equipment utilized and operations performed in conjunction with a subterranean well and, in one example described below, more particularly provides a flow control device for injecting steam into a subterranean formation and producing hydrocarbons from the same subterranean formation.

BACKGROUND

Hydrocarbons, such as oil and gas, are commonly obtained from subterranean formations that may be located onshore or offshore. The development of subterranean operations and the processes involved in removing hydrocarbons from a subterranean formation typically include a number of different steps such as, for example, drilling a wellbore at a desired well site, treating the wellbore to optimize production of hydrocarbons, and performing the necessary steps to produce and process the hydrocarbons from the subterranean formation.

In some subterranean formations, the hydrocarbons are difficult to recover because they are trapped in shale or because the hydrocarbons are not very viscous, e.g., where the hydrocarbons are in the form of tar. In such formations, the formation needs to be treated to make the hydrocarbons more viscous so that they can be produced to the surface. One such technique is to inject steam into the formation to make the hydrocarbons more viscous.

One way of doing this is to drill two horizontal wells into the formation with one well drilled above the other well. Steam is injected into the top well and allowed to permeate through the formation. The hydrocarbons which have become more viscous due to their exposure to the steam are then produced through the bottom well. This technique is commonly known as the Steam Assisted Gravity Drainage (SAGD) method.

Another way of injecting steam into the formation to make the hydrocarbons more viscous is to inject the steam into the formation through a single well. With this technique, the steam may be injected into the formation for long periods of time, for example, six months. Then, once the hydrocarbons have reached a certain viscosity, they are produced through the same well. This technique is known as a Huff & Puff well and used in Canada and other places were tar sands are prevalent. The advantage of a Huff & Puff well is that only one well needs to be drilled.

The present disclosure is directed to an improved device and method for enhancing production from Huff & Puff wells, although as those of ordinary skill appreciate other applications of the device and method disclosed herein may exist.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1A:
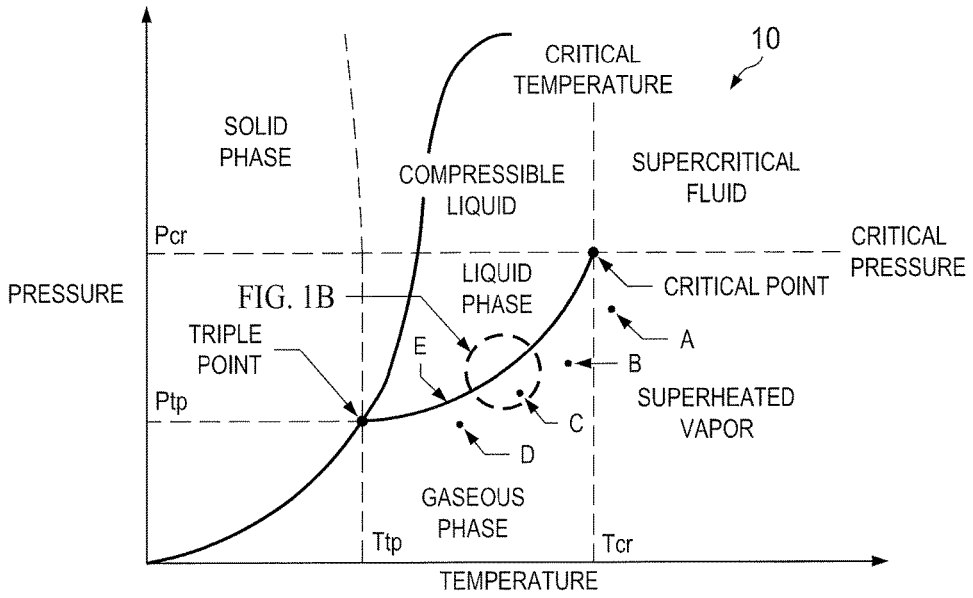
FIGS. 1A & B are a phase diagram for water, FIG. 1B depicting an enlarged detail of a portion of FIG. 1A.

Representatively illustrated in FIG. 1A is the well-known phase diagram 10 for water. Water is used herein as an example of a common fluid which is injected into and produced from subterranean formations. In particular, as noted above, thermally-assisted hydrocarbon recovery methods frequently use injection of water in the form of steam to heat a surrounding formation, and then the water is produced from the formation in liquid form.

Thus, the properties and problems associated with steam injection and subsequent liquid water production in formations are fairly well known in the art. However, it should be clearly understood that the principles of the present disclosure are not limited in any way to the use of water as the injected and/or produced fluid.

Examples of other suitable fluids include hydrocarbons such as naphtha, kerosene, and gasoline, and liquefied petroleum gas products, such as ethane, propane, and butane. Such materials may be employed in miscible slug tertiary recovery processes or in enriched gas miscible methods known in the art.

Additional suitable fluids include surfactants such as soaps, soap-like substances, solvents, colloids, or electrolytes. Such fluids may be used for or in conjunction with micellar solution flooding.

Further suitable fluids include polymers such as polysaccharides, polyacrylamides, and so forth. Such fluids may be used to improve sweep efficiency by reducing mobility ratio.

Therefore, it will be appreciated that any fluid or combination of fluids may be used in addition, or as an alternative, to use of water. Accordingly, the term "fluid" as used herein should be understood to include a single fluid or a combination of fluids, in liquid and/or gaseous phase.

As discussed above, the water is typically injected into the formation after the water has been heated sufficiently so that it is in its gaseous phase. The water could be in the form of superheated vapor (as shown at point A in FIG. 1A) above its critical temperature $T_{cr}$, or in the form of a lower temperature gas (as shown at points B, C & D in FIG. 1A) below the critical temperature, but typically above the triple point temperature $T_{tp}$.

In some examples described below, it is desired that the water produced from the formation be in its liquid phase, so that the water changes phase within the formation prior to being produced from the formation. In this manner, damage to the formation, production of fines from the formation, erosion of production equipment, etc., can be substantially reduced or even eliminated.

However, it is also desired that this phase change take place just prior to production of the water from the formation, so that heat energy transfer from the steam is more consistently applied to the formation, and while the steam is more mobile in the formation, prior to changing to the liquid phase. Thus, in the phase diagram of FIG. 1A, the water produced from the formation would desirably be at a temperature and pressure somewhere along the phase change curve E or, to ensure that production of steam is prevented, just above the phase change curve.

Figure 1B:
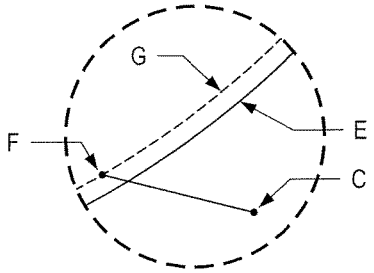

Referring additionally now to FIG. 1B, an enlarged scale detail of a portion of FIG. 1A is representatively illustrated. This detail depicts a fundamental feature of a method which can embody principles of the present disclosure.

Specifically, the detail depicts an example in which flow of the fluid (in this example, water) is controlled so that it is injected into the formation at a pressure and temperature corresponding to point C in the gaseous phase, and is produced from the formation at a pressure and temperature corresponding to point F in the liquid phase. Point F is on a curve G which is just above, and generally parallel to, the phase change curve E. In other examples, the fluid could be injected at any of the other points A, B, D in FIG. 1A, and produced at any other point along the curve G.

Preferably, the fluid is produced at a point on the phase diagram which is on the curve G, or at least above curve G. Thus, the curve G represents an ideal production curve representing a desired phase relationship or phase state at the time of production. Stated differently, curve G represents a maximum temperature and minimum pressure phase relationship relative to the liquid/gas phase change curve E.

Note that such phase-based flow control of the fluid cannot be based solely on temperature, since at a same temperature the fluid could be a gas or a liquid, and the flow control cannot be based solely on pressure, since at a same pressure the fluid could also be a gas or a liquid. Instead, this disclosure describes various ways in which the flow control is based on the phase of the fluid.

In examples described below, various flow control devices can be used in well systems to obtain a desired injection of steam and production of water and then hydrocarbons, but it should be understood that this disclosure is not limited to these examples. Various other benefits can be derived from the principles described below. For example, the flow control devices can be used to provide a desired quantitative distribution of steam along an injection wellbore, a desired quantitative distribution of water along a production wellbore, a desired temperature distribution in a formation, a desired steam front profile in the formation, etc.

Figure 2:
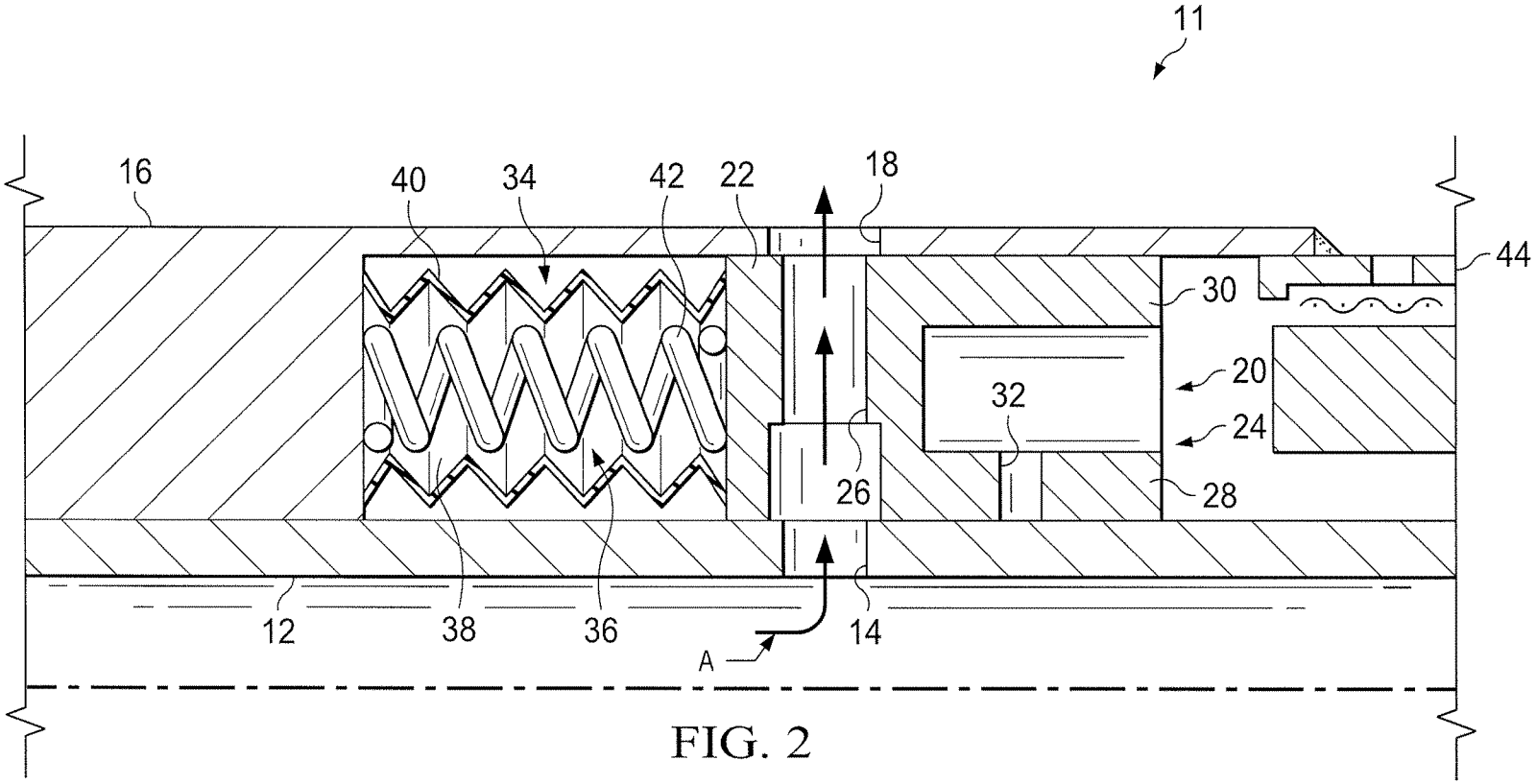
FIG. 2 is a representative cross-sectional view of a flow control device which can embody principles of this disclosure illustrating the flow control device in a first position wherein a first fluid is shown flowing through the device and wherein the flow control device is formed on a base pipe.

Representatively illustrated in FIG. 2 is a flow control device 11 which can embody principles of this disclosure. The flow control device 11 operates in one mode to permit steam to be injected into a subterranean formation known to contain hydrocarbons which are not very viscous, e.g., tar. In another mode, the flow control device 11 operates to another mode to permit water and the hydrocarbons to flow to the surface once the steam has been injected into the formation thereby increasing the viscosity of the hydrocarbons so as to make them easier to produce.

Figure 3:
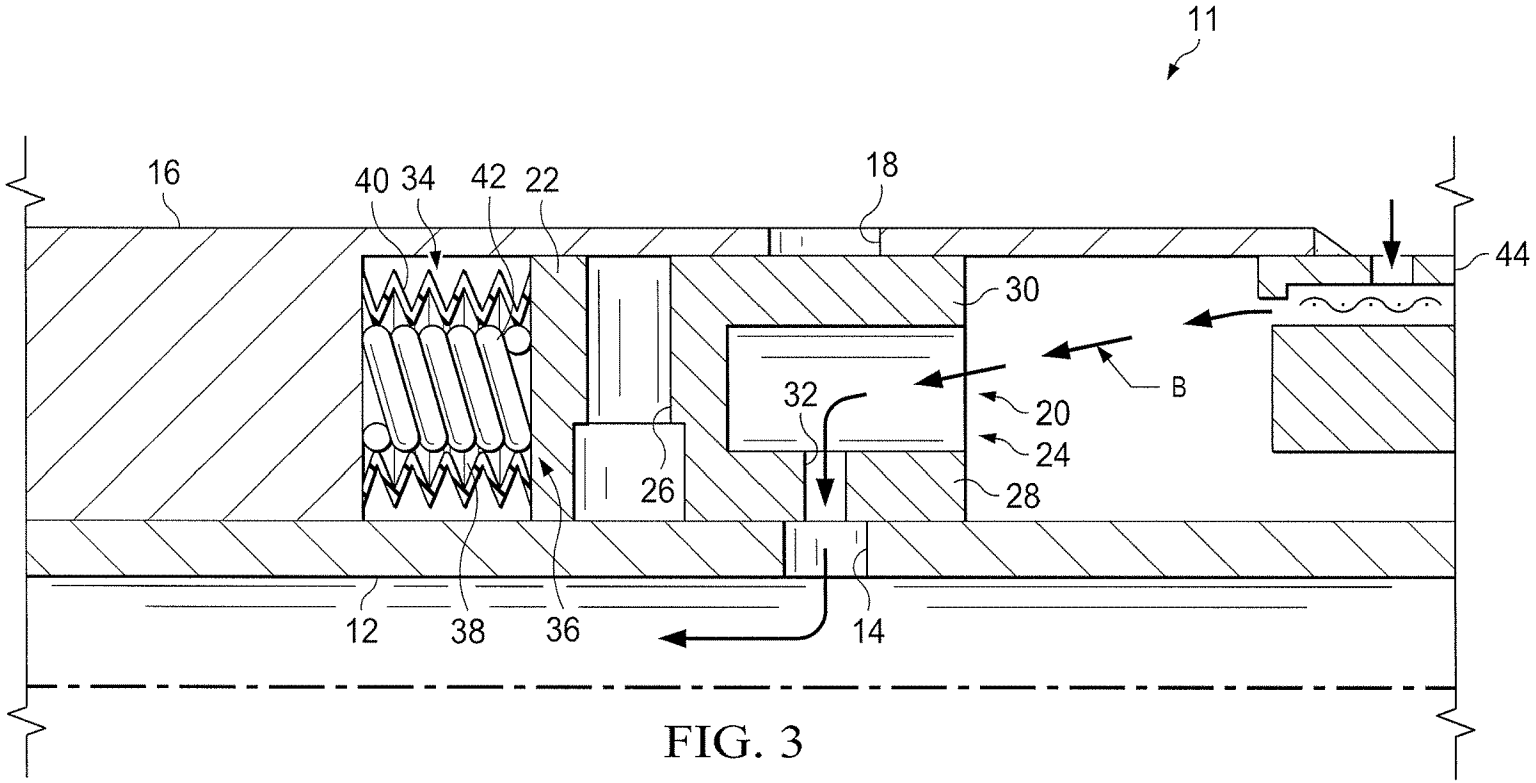
FIG. 3 is a cross-sectional view of the flow control device shown in FIG. 2 illustrated in a second position wherein a second fluid is shown flowing through the device.
Figure 4:
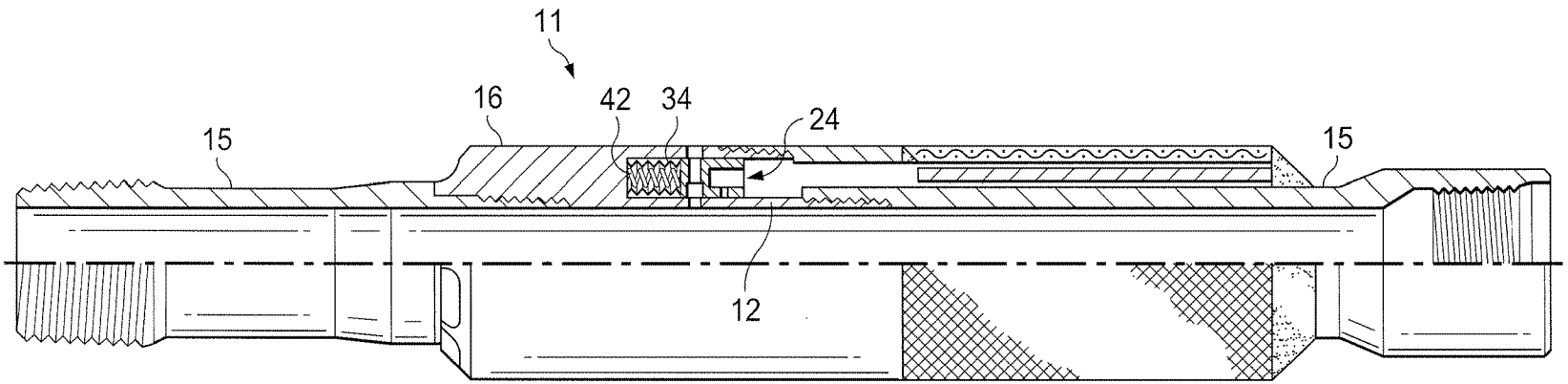
FIG. 4 is cross-sectional view of another embodiment of flow control device in accordance with the present disclosure wherein the flow control device is formed as its own sub.

The flow control device 11 fits over a mandrel 12 formed with one or more ports 14 disposed around its circumferential surface. The mandrel 12 can be production tubing or casing, as shown in FIGS. 2 and 3. Alternatively, the flow control device 11 can be formed as its own sub, which can be linked together with a section of production tubing or casing 15, as shown in FIG. 4. The flow control device 11 includes a housing 16, which is formed with one or more ports 18 disposed around its circumferential surface. The housing 16 is designed to be disposed around the mandrel 12 adjacent the ports 14. In one embodiment, the ports 18 in the housing 16 are radially aligned with the ports 14 in the mandrel 12. The flow control device 11 further includes a generally cylindrical piston 20 disposed between the housing 16 and the mandrel 12.

The piston 20 has a solid body portion 22 and a flanged portion 24. The solid body portion 22 is formed with one or more ports 26 formed through the radial thickness of the body. The one or more ports 26 correspond generally in number and size to the ports 14 in the mandrel 12 and the ports 18 in the housing 16. The flanged portion 24 of the piston 20 has an inner flange 28, which is disposed adjacent to the outer wall of the mandrel 12 and an outer flange 30, which disposed adjacent to the inner wall of the housing 16. The inner flange 28 has one or more ports 32 disposed around the circumferential surface of the piston 20. The number of ports 32 corresponds to a flow restriction that creates enough of a pressure drop, at a given flow rate, to enable the production of the liquid and/or hydrocarbon to be adequately balanced along the length of the wellbore; thereby, reducing the heel-toe effect of long wells and/or mitigating the uneven production caused by a heterogeneous reservoir. Also, the ports 32 are in fluid communication with ports 14. The combined ports 32 are generally smaller in size or overall flow area than the combined ports 14, 18 and 26. The smaller ports 32 control the rate at which hydrocarbons are produced to the surface.

The flow control device 11 further includes a bellows 34. The bellows 34 is designed to slide the piston 20 longitudinally along the mandrel 12 and the housing 16 from a first position where the ports 26 in the piston may align with the associated ports 14 in the mandrel 12 and the ports 18 in the housing 16. There is a chamber 36 disposed within the bellows 34 which contains a fluid 38. The bellows 34 is defined by a wall 40 and may also include a biasing device 42 (such as a mechanical spring), which can apply a biasing force to alter the pressure in the chamber 36, as shown in FIG. 2. In one exemplary embodiment, only a single fluid 38 may be disposed within the chamber 36 with water being the single fluid. In another exemplary embodiment, azeotrope may be disposed within the chamber 36.

As the temperature increases and/or the pressure decreases, the flow control device 11 could move to a first position, e.g., to permit relatively unrestricted flow of saturated steam as indicated by arrows A in FIG. 2. Further temperature decrease and/or pressure increase causing the water 38 in the chamber 36 to condense can result in the flow control device 11 to move to the a second position, e.g., to permit water and/or hydrocarbons to flow into the mandrel 12 from the subterranean formation as indicated by the flow path B shown in FIG. 3. In this position, the port 32 in the inner flange 28 is aligned with port 14 in the mandrel 12.

The flow control device 11 further includes a filter 44, which is provided to filter out rocks, sand and other debris from the fluids being produced to the surface. The filter 44 may be formed of one or more fine metal screens, but may be formed of any other material capable of being withstanding the harsh downhole environment. Those of ordinary skill in the art will appreciate which types of filters to use for a given application.

Note that, in any of the examples of the flow control device 11 described above, pressure in the chamber 36 can be above or below the liquid-gas phase change curve E of FIGS. 1A & B. The biasing device 38 can increase or decrease the pressure as desired. The biasing force exerted by the biasing device 38 can be varied as a function of displacement of the wall 40 to facilitate desired operation of the piston 20.

In some examples, the biasing force can transition between positive and negative. This provides for further fine tuning of the piston's response to changes in pressure, temperature and pressure differential at the flow control device 11.

It may now be fully appreciated that the above disclosure provides significant advances to the art of constructing and operating flow control devices to control a phase of fluid flow in a well. In some examples described above, water 38 is disposed in a chamber 36 having a variable volume. A biasing device 42 reduces or increases the pressure in the chamber 36.

The biasing device 42 may bias the wall 40 of the chamber 36 outward. The biasing device 42 may apply a biasing force which decreases the pressure in the chamber 36. The biasing device 42 may include a classic metal spring in the chamber 36. The biasing device 42 may also include a wall of the chamber 36 (such as, the wall 40 of the bellows 42).

Figure 5:
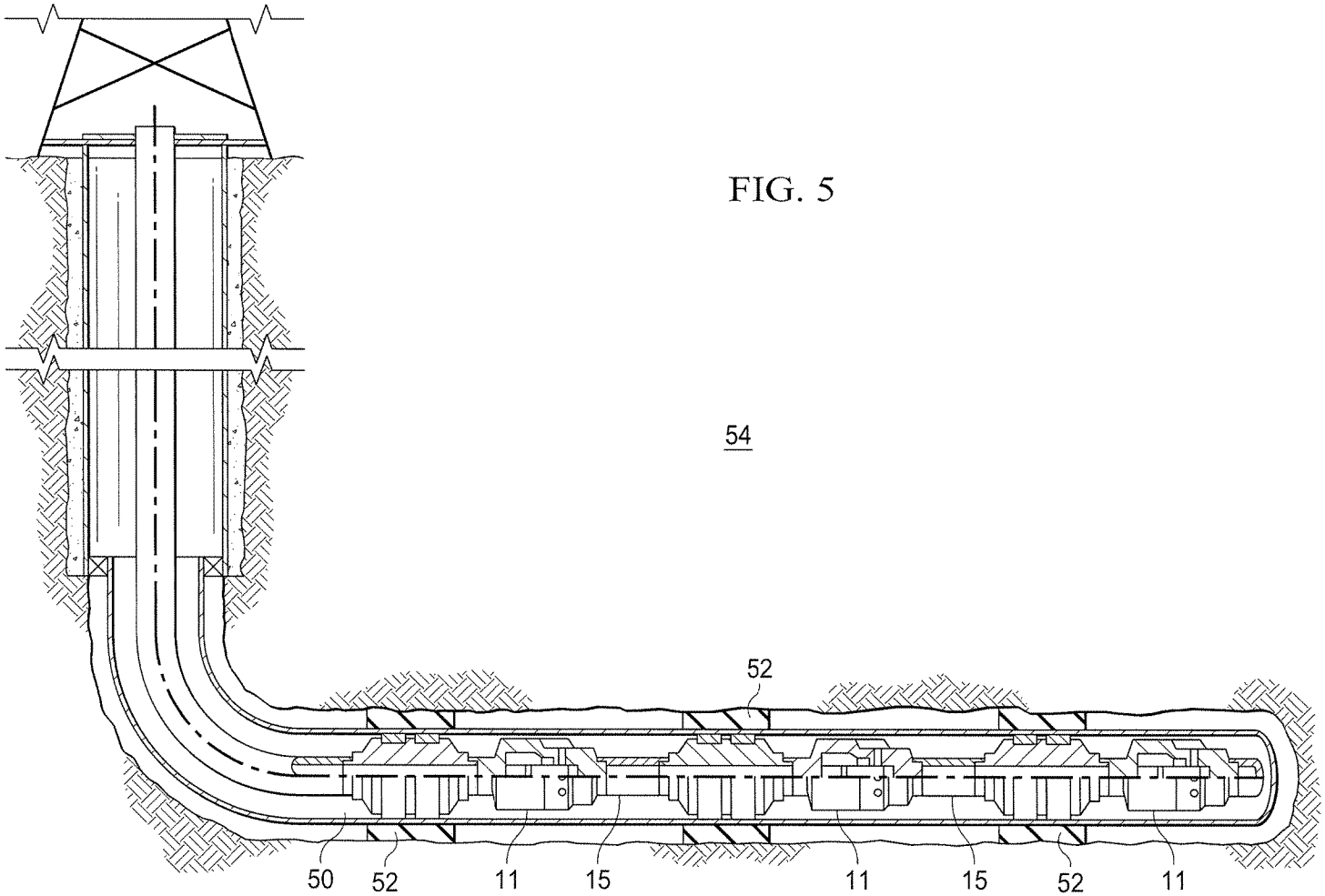
FIG. 5 is a schematic diagram illustrating a plurality of flow control devices in accordance with the present disclosure disposed along a wellbore in a subterranean formation.

As shown in FIG. 5, a plurality of flow control devices 11 may be disposed along the length of the wellbore 50 between isolated regions of the wellbore formed between adjacent packers 52. The plurality of flow control devices 11 are placed along those regions of the subterranean formation 54 believed to contain the hydrocarbons of interest. FIG. 5 illustrates the wellbore 50 as a horizontal well, but as those of ordinary skill will appreciate, the wellbore 50 can be a vertical well, a deviated well, or other combination of the various types of well configurations.

Also described herein is a method of controlling the flow of steam and production of hydrocarbons in a well. In one example, the method comprises delivering the flow control device 11 downhole to a region in the subterranean formation containing hydrocarbons, the flow control device 11 being formed of the mandrel 12 and port 14 formed therein, housing 16 disposed around the mandrel 12 having port 18 formed therein, piston 20 formed between the mandrel 12 and the housing 16 having first and second ports 26 and 32, with the first port 26 being larger than the second port 32, and bellows 34 formed between an inner surface of the housing 16 and an outer surface of the piston 20, the bellows having a fluid 38 contained therein; pumping steam down the mandrel 12, the steam warming the fluid 38 in the bellows 34 thereby causing it to expand so that the bellows slides the piston 20 into a first position whereby the first port 26 of the piston aligns with the ports 14 and 18 in the mandrel and the housing, respectively; and injecting the steam into the subterranean formation upon alignment of the first port 26 in the piston 20 and the ports in the mandrel and the housing 14 and 18, respectively.

The method further includes ceasing injection of the steam into the subterranean formation when the hydrocarbons become viscous enough to produce by flowing them through the mandrel to the surface. The method further includes allowing the fluid contained within the bellows to cool thereby causing the bellows to contract so as to move the piston to slide into a second position wherein the second port aligns with the ports in the mandrel and the housing. The hydrocarbons from the subterranean formation flow through the ports in the mandrel, housing and piston and into the mandrel when the piston is in the second position. The method further includes filtering the hydrocarbons of debris before producing them to the surface. As those of ordinary skill will appreciate, water will likely be produced to the surface with the hydrocarbons. The method also may include applying a biasing force to the bellows so as to alter the pressure of the chamber therein. As those of ordinary skill in the art will appreciate, the method can be repeated in different regions of the subterranean formation 54, as illustrated in FIG. 5.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A flow control device, comprising:

a mandrel with a port formed therein;

a housing disposed around the mandrel having a port formed therein;

a piston disposed between the mandrel and the housing, wherein the piston comprises a first port and a second port that are formed through a body of the piston thereby allowing a fluid to flow through the piston without entering the housing, and wherein the first port is larger than the second port; a bellows disposed between an inner surface of the housing and an outer surface of the piston, the bellows having a chamber therein which contains the fluid, the fluid being capable of expanding and contracting in response to changes in temperature and/or pressure, wherein expansion and contraction of the bellows operates to move the piston.

2. The flow control device according to claim 1, further comprising a filter attached to the housing between the mandrel and the housing.

3. The flow control device according to claim 2, wherein the filter is formed of one or more fine metal screens which are capable of filtering rock and other debris from subterranean and other downhole fluids.

4. The flow control device according to claim 1, wherein the piston is formed of cylindrical body portion and a flanged portion having a first flange disposed adjacent an outer circumferential surface of the mandrel and a second flange disposed adjacent an inner circumferential surface of the housing.

5. The flow control device according to claim 4, wherein the second port is formed in the first flange portion of the piston thereby allowing fluid within the housing to pass through the piston into the mandrel.

6. The flow control device of claim 1, wherein the bellows is capable of moving the piston to a first position wherein the first port in the piston aligns with the ports in the mandrel and the housing so as to permit a first fluid to flow from the mandrel through the piston and housing.

7. The flow control device of claim 1, wherein the bellows is capable of moving the piston to a position wherein the second port in the piston aligns with the ports in the mandrel and the housing so as to permit a second fluid to flow from the mandrel through the piston and housing.

8. The flow control device of claim 1, wherein the bellows comprises a biasing device.

9. The flow control device of claim 8, wherein the biasing device is capable of applying a biasing force which increases the pressure in the chamber.

10. The flow control device of claim 8, wherein the biasing device is a spring.

11. The flow control device of claim 1, wherein the fluid disposed within the chamber of the bellows comprises only water.

12. The flow control device of claim 1, wherein an azeotrope is disposed within the chamber of the bellows.

13. A method of injecting steam into a subterranean formation and producing hydrocarbons therefrom, comprising:

(a) delivering a flow control device downhole to a region in the subterranean formation containing the hydrocarbons, the flow control device formed of a mandrel having a port formed therein, a housing disposed around the mandrel having a port formed therein, a piston formed between the mandrel and the housing, wherein the piston comprises a first port and a second port formed through a body of the piston thereby allowing a fluid to flow through the piston without entering the housing, the first port being larger than the second port, and a bellows formed between an inner surface of the housing and an outer surface of the piston, the bellows having a chamber with the fluid contained therein;

(b) pumping steam down the mandrel, the steam warming the fluid in the bellows thereby causing it to expand so that the bellows slides the piston into a first position whereby the first port of the piston aligns with the ports in the mandrel and the housing; and (c) injecting the steam into the subterranean formation upon alignment of the first port in the piston and the ports in the mandrel and the housing.

14. The method according to claim 13, further comprising:

ceasing injection of the steam into the subterranean formation when the hydrocarbons become viscous enough to produce by flowing them through the mandrel to the surface.

15. The method according to claim 13, further comprising: allowing the fluid contained within the bellows to cool thereby causing the bellows to contract so as to move the piston to slide into a second position wherein the second port aligns with the ports in the mandrel and the housing.

16. The method according to claim 15, wherein the hydrocarbons from the subterranean formation flow through the ports in the mandrel, housing and piston and into the mandrel when the piston is the second position.

17. The method according to claim 13, further comprising filtering the hydrocarbons of debris before producing them to the surface through the mandrel.

18. The method according to claim 13, further comprising applying a biasing force to the bellows so as to increase the pressure in the chamber.

19. The method according to claim 13, further comprising repeating steps (a) through (c) in another region of the subterranean formation.

* * * * *